United States Patent [19]

Gallier

[11] Patent Number: 4,945,692

[45] Date of Patent: Aug. 7, 1990

[54] PREFABRICATED CHIMNEY MANTEL

[75] Inventor: Michel Gallier, Cusset, France

[73] Assignee: Marges S.A.R.L., Chamalieres, France

[21] Appl. No.: 329,372

[22] Filed: Mar. 27, 1989

[51] Int. Cl.[5] ..... F24C 15/06

[52] U.S. Cl. ..... 52/36; 52/315

[58] Field of Search ..... 52/36, 315, 316; D23/404; 126/544, 547

[56] References Cited

U.S. PATENT DOCUMENTS 417,914 12/1889 Graves ..... D23/404

865,510 9/1907 Marcks ..... 52/36

1,630,910 5/1927 Weissinger ..... 52/315

FOREIGN PATENT DOCUMENTS 35844 3/1980 Japan ..... 52/36

*Primary Examiner*—John E. Murtagh

*Attorney, Agent, or Firm*—Marilyn Brogan

[57] ABSTRACT

A three piece chimney mantel to be disposed about a fireplace. The three pieces are the lintel and a pair of supporting legs. Each of the pieces is formed of a monobloc composite material of binder and inorganic fibrous material formed in the shape of a hollow trough.

9 Claims, 2 Drawing Sheets

PREFABRICATED CHIMNEY MANTEL

Figure 1:
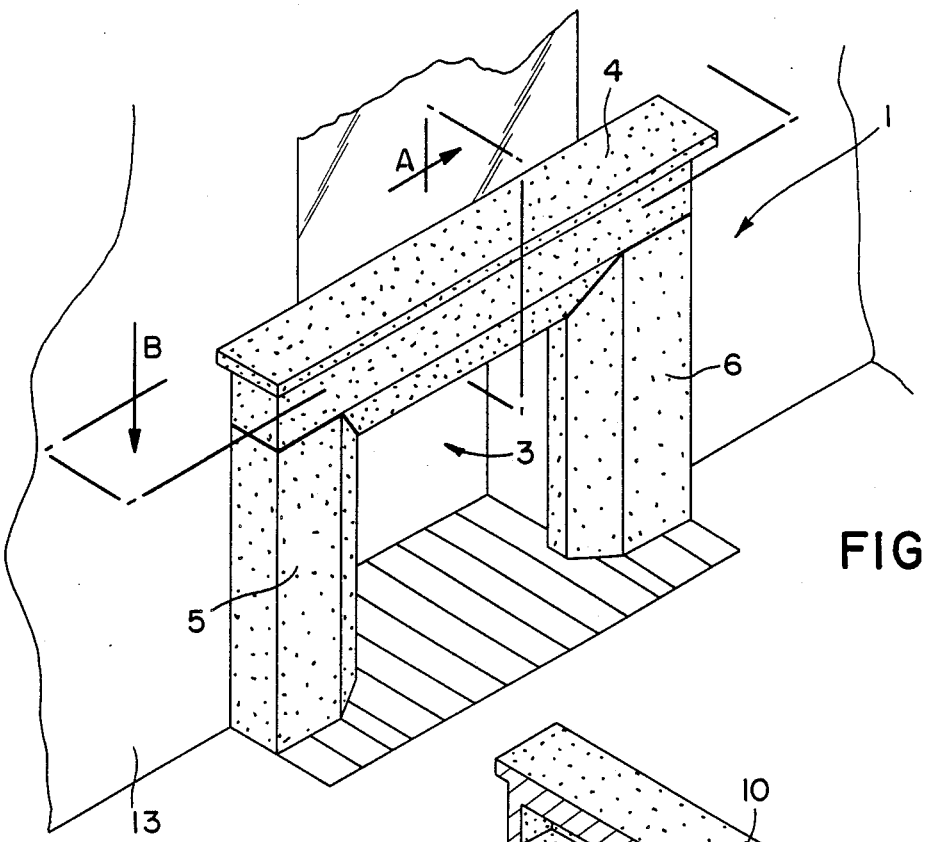

The present invention is from the field of interior decoration and its subject is a chimney mantel.

It will be recalled that fireplaces in houses, provided in the lower part of the walls of a room, are generally surrounded by a mantel arrangement which acts, on the one hand, to protect the wallpaper from the heat and, on the other hand, to decorate the fireplace and the room.

It will also be recalled that, traditionally, chimney mantels are constructed using various materials (brick or stone) and are covered with decorated or undecorated marble plates which are sealed on the frame; sometimes the upper part of the mantel, called the lintel, consists of a solid wood beam; sometimes the supports (side parts), or legs, of the mantel are also covered with carved or uncarved wood. In this traditional way, the fitting of a chimney mantel is a task for specialists and this has made it very expensive nowadays; because of this cost, chimneys of this type are not altered after their construction despite subsequent changes in decor of the surrounding room.

The aim of the present invention is to propose a chimney mantel which is both easily transported, fitted and dismantled by an individual and which has a sufficiently low cost for the individual to be able to change it at the same time as he changes the decor of the room; moreover, it is essential that such a mantel complies with fireproofing requirements of traditional chimney mantels.

According to the present invention, a chimney mantel of the type consisting of a pair of legs and of a lintel supported by the legs, the whole being intended to frame a fireplace arranged in the lower part of a wall, is generally defined in that each of the three pieces forming the mantel is a monobloc piece produced from a composite material comprising a binder and an inorganic fibrous material, and in that each of the pieces has a hollow trough shape which is open on one face, the opening edge being located in a plane.

Preferably, the said binder is plaster and, with the fibrous material, forms the composite material known under the name of STAFF; the binder could also be plaster with added adhesive and marble powder, the material then being known under the name of STUCCO; finally, the binder could be a cement.

Preferably, the fibrous material is at least one of the materials of the group comprising glass "wool" and mineral "wool".

Preferably, the contact surfaces between the lintel and the legs are dihedral surfaces; one of the dihedral surfaces is a substantially horizontal surface and two horizontal surfaces facing each other having opposing reliefs (male and female) intended to center the pieces with respect to each other.

According to another aspect of the invention, at least the lintel comprises at least one elongated stiffening insert, embedded in the fibrous material, which gives rise to the possibility of quite a large length of the lintel for certain types of chimney.

According to another aspect of the invention, the said composite material (staff) has an outer layer which is harder than the inner layers, with the result that, without substantially increasing the cost of manufacture, the chimney may be given a surface which can normally withstand the small impacts which are customary during normal use of a room.

Figure 2:
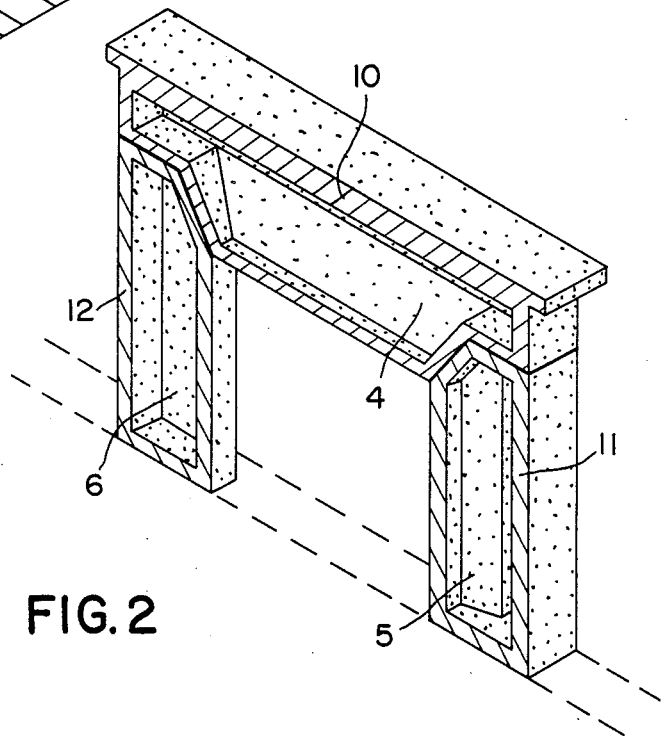
Figure 3:
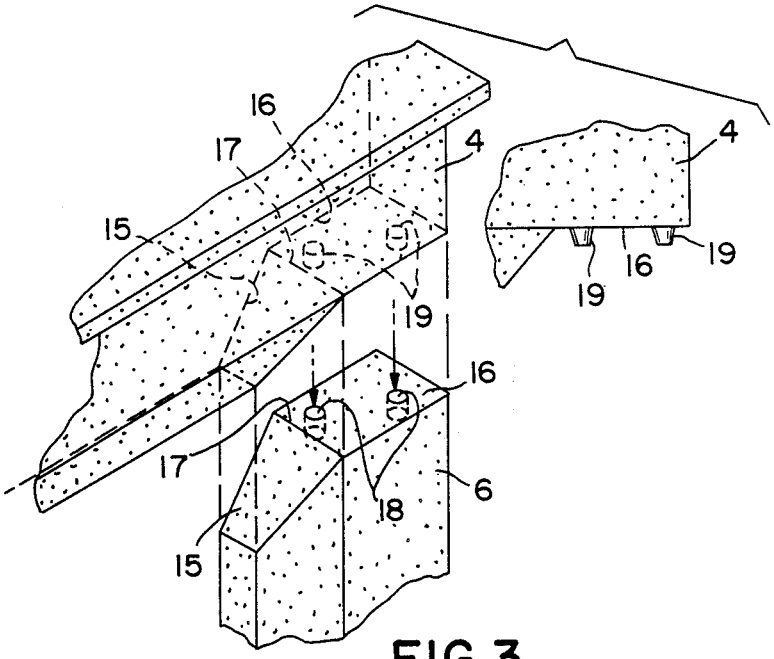
Figure 4:
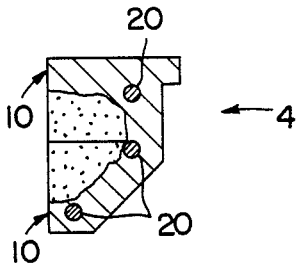
Figure 5A:
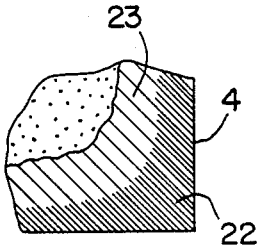
Figure 5:
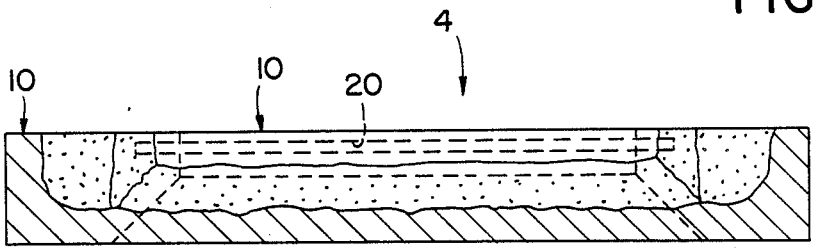

The present invention will be better understood and the relevant details will emerge from the following description given of a particular, simplified embodiment of the invention with respect to the figures of the appended plates, wherein:

FIG. 1 is a perspective of a chimney mantel of the invention, seen from the front, FIG. 2 is another perspective, seen from the rear, FIG. 3 is an exploded perspective illustrating an assembly detail, FIG. 4 is a section of the lintel according to the arrow A of FIG. 1, FIG. 5 is a section of the same according to the arrow B; FIG. 5*a* is an enlarged detail.

In FIGS. 1 and 2, it appears that a chimney mantel designated by 1 overall, surrounding a fireplace 3, consists of a lintel 4 supported by two legs 5 and 6; according to the invention and as appears clearly in FIG. 2, each of these three pieces 4, 5, 6 is a monobloc piece with a hollow trough shape open on one face (rear face), the edges of the opening of each piece, such as the edges 10, 11, 12, respectively, of each of them being located in a plane; when the chimney mantel is fitted, the rear opening planes of each of the pieces are coplanar and coincident with the plane formed by the wall 13 of the room against which the mantel is applied.

In FIG. 3 a certain number of details are shown which allow the satisfactory positioning of the pieces with respect to each other; firstly, the contact surface between the lintel 4 and a leg such as 6 is, for one leg for example, a dihedral surface formed by two plane faces 15 and 16 joining together at an edge 17; corresponding elements 15', 16' and 17' are located on the inner face of the lintel. The faces 16 of the leg and 16' of the lower face of the lintel are substantially horizontal surfaces; the face 16 comprises two small frustoconical cavities 18 (female relief) and the face 16' of the lintel comprises two small pegs 19 which are also frustoconical (male relief) and intended to be inserted in the cavities 18; of course, the pegs 19 and the cavities 18 occupy positions which require the correct positioning of the lintel with respect to the leg.

The hollow structure which is a principal characteristic element of the invention is well illustrated by the sections of FIGS. 4 and 5 which represent the lintel 4 in section; a similar structure is present for each of the legs 5 and 6, although this section has not been shown in the figures.

Certain details appear on these latter figures and on the FIG. 5*a*: firstly, it appears that the lintel comprises several elongated inserts 20 serving to stiffen it and arranged in the thickness of its wall, it being possible for such inserts to be metal profiles in aluminum, for example such as profiles in angle steel, in a tube shape or in an I shape; it appears in the inset 5*a* that, according to an advantageous embodiment, the composite material forming each of the pieces 4, 5 and 6 has an outer layer 22 which is different from the inner layer 23, the difference principally being a difference of hardness of the material. It will be recalled that a chosen material for forming these pieces is STAFF, that is to say a material essentially consisting of plaster and of a fibrous material which, according to a characteristic of the invention, is an inorganic fibrous material; the hardest layer may be produced from a variety of plaster having greater hardness than the plaster used for the inner layer or alternatively plaster with added adhesive; this choice is known to specialists in the field.

It must be understood that the subject of the present invention is not a particular shape of chimney mantel, in fact, by virtue of their decorative role, the latter an have very diverse shapes, borrowing ancient styles of which they may ultimately be copies; therefore, the scope of the invention is not limited to this shape but extends to any chimney mantel comprising the general characteristics set forth above.

I claim:

1. A three piece chimney mantel comprising a pair of legs and lintel supported by the legs, the whole being intended to frame a fireplace arranged in the lower part of a wall wherein each of the three pieces (4,5,6) forming the mantel (1) is a monobloc piece produced from a composite material comprising a binder and an inorganic fibrous material, and wherein each of the pieces (4,5,6,) has a hollow trough shape which is open on one face, the opening edges (10,11,12) being located in a plane.

2. The chimney mantel as claimed in claim 1, wherein the fibrous material is at least one of the materials selected from the group consisting of glass wool or mineral wool.

3. The chimney mantel as claimed in claim 2, having contact surfaces (15, 16, 15', 16') between the lintel (4) and the legs (5,6) and wherein the contact surfaces are dihedral surfaces.

4. The chimney mantel as claimed in claim 1, having two dihedral surfaces (16,16') and wherein one of the dihedral surfaces is a substantially horizontal surface and wherein two horizontal surfaces (16,16') opposite one another comprise opposing male and female reliefs (18,19) intended for centering the pieces (4,5,6,) with respect to each other.

5. The chimney mantel as claimed in claim 1, wherein at least the lintel comprises at least one elongated stiffening insert (20) embedded in the fibrous material.

6. The chimney mantel as claimed in claim 2, wherein the composite material has an outer layer (22) which is harder than the inner layers (23).

7. The chimney mantel as claimed in claim 1, wherein the binder is plaster.

8. The chimney mantel as claimed in claim 1, wherein the binder is plaster having added adhesive and marble powder.

9. The chimney mantel as claimed in claim 1, wherein the binder is cement.

* * * * *